US005343581A

United States Patent [19]

Bartley et al.

[11] Patent Number: 5,343,581

[45] Date of Patent: Sep. 6, 1994

[54] HOUSING AND DRIVE MECHANISM FOR SCREW LIFT OF HOSPITAL BED

[75] Inventors: Gary L. Bartley; Christopher J. Hopper, both of Kalamazoo, Mich.

[73] Assignee: Stryker Corporation, Kalamazoo, Mich.

[21] Appl. No.: 964,602

[22] Filed: Oct. 21, 1992

[51] Int. Cl.[5] ..... A61G 7/00

[52] U.S. Cl. ..... 5/611; 5/616; 5/424; 254/103; 254/DIG. 2

[58] Field of Search ..... 5/611, 616, 424, 613; 254/7 R, 7 C, 92, 100, 102, 103, 425, DIG. 2

[56] References Cited

U.S. PATENT DOCUMENTS

| | | | |
|---|---|---|---|
| 1,279,346 | 9/1918 | Hultgren et al. | 254/DIG. 2 |
| 1,565,878 | 12/1925 | White . | |
| 1,792,339 | 2/1931 | Weidner | 254/103 |
| 1,874,357 | 8/1932 | Runyan . | |
| 1,874,772 | 8/1932 | Lucker . | |
| 1,906,365 | 5/1933 | Burkholder . | |
| 1,933,777 | 11/1933 | Trant | 254/102 |
| 2,127,309 | 8/1938 | Rickard . | |
| 2,481,477 | 9/1949 | Peery | 5/616 X |
| 2,522,759 | 9/1950 | Lindquist . | |
| 2,969,222 | 1/1961 | Sears | 254/103 |
| 3,062,504 | 11/1962 | Blanchard | 254/DIG. 2 |
| 3,253,284 | 5/1966 | St. John . | |
| 3,581,319 | 7/1971 | Stanley et al. | 5/616 |
| 3,633,225 | 1/1972 | Burst et al. | 5/424 X |
| 3,808,613 | 5/1974 | Carpentier et al. | 5/616 |
| 3,888,464 | 6/1975 | Felsen | 254/425 |
| 4,101,120 | 7/1978 | Seshima | 5/616 |
| 4,324,010 | 4/1982 | Houlberg et al. | 5/616 |
| 4,609,179 | 9/1986 | Chern et al. . | |
| 5,172,442 | 12/1992 | Bartley et al. | 5/611 |

FOREIGN PATENT DOCUMENTS

| | | | |
|---|---|---|---|
| 3108208 | 9/1982 | Fed. Rep. of Germany . | |
| 2191873 | 2/1974 | France . | |
| 2664253 | 1/1992 | France . | |
| 697233 | 9/1953 | United Kingdom | 254/100 |

*Primary Examiner*—Michael F. Trettel
*Attorney, Agent, or Firm*—Flynn, Thiel, Boutell & Tanis

[57] ABSTRACT

A drive mechanism for a hospital bed effects relative vertical movement of a base and a patient litter. The drive mechanism includes spaced, telescoping threaded screw assemblies, which are driven by a single electric motor through a train of gears having helical teeth oriented to offset inherent frictional forces of the screw assemblies. A support for the motor and a component of the drive train are made of electrically nonconductive materials to electrically isolate the motor, and are arranged to damp vibrations produced by the motor. Two coiled electrical cords extend between the base and patient litter, and are each received in a recess in the patient litter when the patient litter is adjacent the base. A sensor arrangement provides an electrical signal indicative of the relative vertical positions of the patient litter and base, and a manual drive arrangement is provided to permit the gear train to be manually driven.

25 Claims, 3 Drawing Sheets

HOUSING AND DRIVE MECHANISM FOR SCREW LIFT OF HOSPITAL BED

FIELD OF THE INVENTION

The present invention relates to a mechanism which moves a patient support portion of a hospital bed vertically with respect to a base portion and, more particularly, to such a mechanism which has a threaded member operatively engaging and rotatable relative to a nut.

BACKGROUND OF THE INVENTION

Over the years, various arrangements have been developed to effect vertical movement of a patient support portion of a hospital bed with respect to a base. For example, upward and downward movement of a patient support litter relative to a base has been effected with a pair of spaced hydraulic cylinders which have housings fixedly mounted on the base and which have vertically extending piston rods with their upper ends fixedly secured to the patient support portion. However, hydraulic arrangements tend to drip oil, which creates a mess and in some cases presents a safety problem when the oil ends up on a floor surface where someone may slip on it. Further, in order to be competitive in today's marketplace, a hydraulic arrangement must usually include both electrically and manually actuated pumps, because the convenience of electrical pumps is normally desired but manual pumps are necessary for emergency circumstances during an electrical power outage. However, the provision of both manual and electrical systems can render the resulting bed relatively complex and expensive.

One alternative approach is to use a lift mechanism which includes a vertically extending threaded member operatively engaging a nut, and includes a drive arrangement to effect relative rotation of the threaded member and nut in order to provide vertical movement of the threaded member relative to the nut. An example of such a mechanism is disclosed in copending U.S. Ser. No. 07/816,826, filed Jan. 3, 1992 now U.S. Pat. No. 5,172,442 . While this known mechanism has been a distinct improvement over prior approaches and has been entirely adequate for its intended purposes, it has not been satisfactory in all respects.

It is the object of the present invention to provide, for a hospital bed, an improved lift mechanism of the type which includes a threaded member engaging and rotatable relative to a threaded part such as a nut.

It is a further object to provide such a lift mechanism in which the noise generated by the lift mechanism during operation is minimal, and in which certain friction-producing forces are compensated at least in part by opposite forces in order to reduce friction and thus achieve increased efficiency.

It is a further object to provide such a mechanism in which the drive mechanism is operated by an electric motor and the electric motor is electrically isolated from all of the components of the lift mechanism in a simple and inexpensive manner.

It is a further object to provide such a mechanism in which an electrical cord signals for the lift mechanism is kept spaced from moving components of the lift mechanism in a tangle-free manner as the lift mechanism moves the patient support part vertically with respect to the base.

It is a further object to provide such a mechanism in which a simple and inexpensive arrangement is provided to generate an electrical signal indicative of the vertical position of the patient support part relative to the base.

A further object is to provide such a mechanism in which a reliable but simple manual drive arrangement is provided to permit manual operation of the lift mechanism.

SUMMARY OF THE INVENTION

The objects and purposes of the invention, including those set forth above, are met according to one form of the invention by providing a lift arrangement which effects relative vertical movement of first and second members, and which includes a vertically extending threaded member, a motor, and a drive train for effecting vertical movement of the threaded member in response to operation of the motor, the drive train including two gears having engaging helical teeth which minimize noise generated by the drive train.

According to a different form of the invention, a lift arrangement for effecting relative vertical movement of first and second members includes a vertically extending threaded member, a rotatably supported output member, and an arrangement for effecting axial movement of the threaded member in response to rotation of the output member, the output member being urged in a first axial direction in response to axial movement of the threaded member, and a drive train arrangement being provided to effect rotation of the output member while simultaneously urging the output member in a second axial direction opposite the first axial direction.

In a further form of the present invention, a lift arrangement for effecting relative vertical movement of first and second members includes an elongate cylindrical member having external threads and a tubular nut member disposed in an opening in a further member and having internal threads engaging the threads of the cylindrical member, the opening in the further member having at an upper end thereof an enlarged portion and the nut member having adjacent an upper end thereof a collar portion which is disposed in the enlarged portion of the opening, the collar portion and the enlarged portion having structure which prevents relative rotation of the nut member and further member, an arrangement being provided for effecting relative rotation of the cylindrical member and further member.

Still another form of the invention involves the provision of a lift arrangement for effecting relative vertical movement of first and second members, the lift arrangement including a housing provided on one of the first and second members and having a threaded part thereon, a vertically extending cylindrical member coupled to the second member and having external threads which engage the threaded part, a selectively actuable motor, a drive train for effecting relative rotation between the cylindrical member and threaded part in response to operation of the motor, and a motor support part supported on the housing and made of an electrically nonconductive material, the motor being supported on the motor support part and the drive train including an electrically nonconductive coupling part which electrically isolates the motor from the drive train.

A different form the invention relates to a lift arrangement for effecting relative vertical movement of a patient support portion relative to a bed base, wherein a coiled electrical cord extends between the base portion and patient support portion and expands and contracts in response to relative vertical movement between them.

A different form of the invention involves a lift arrangement which effects relative vertical movement of first and second members and which includes vertically extending first and second cylindrical members having external threads and having a noncircular portion at one end thereof, first and second threaded parts each rotatably supported with respect to the first member and each engaging a respective cylindrical member, a selectively actuable motor, and an arrangement driven by the motor for simultaneously effecting relative rotation of the threaded parts and cylindrical members, the second member having therein two spaced noncircular openings which each receive the noncircular portion of a respective one of the cylindrical members.

The invention also involves the provision of a lift arrangement which effects relative vertical movement of first and second members and which includes a vertically extending cylindrical member coupled to the first member, a threaded part supported on the second member and engaging the cylindrical member, a selectively actuable motor, a drive train driven by the motor for effecting relative rotation of the threaded part and cylindrical member, a potentiometer having a shaft rotated by the drive arrangement synchronously with relative rotation of the threaded part and cylindrical member so that the potentiometer outputs an electrical signal representative of the relative vertical position of the first and second members, and a circuit having an input to which the signal from the potentiometer is applied.

Another form of the invention involves a lift arrangement which effects relative vertical movement of a patient support portion and a base portion of a bed, and which includes a vertically extending cylindrical member with external threads, a threaded part which engages the cylindrical member, a selectively actuable motor, and a drive train driven by the motor for effecting relative rotation of the cylindrical member and threaded part, the drive train including a manual drive member which can be manually moved to cause the drive train to effect the relative rotation of the cylindrical member and threaded part.

BRIEF DESCRIPTION OF THE DRAWINGS

A preferred embodiment of the present invention is described in detail hereinafter with reference to the accompanying drawings, in which.

DETAILED DESCRIPTION

Figure 1:
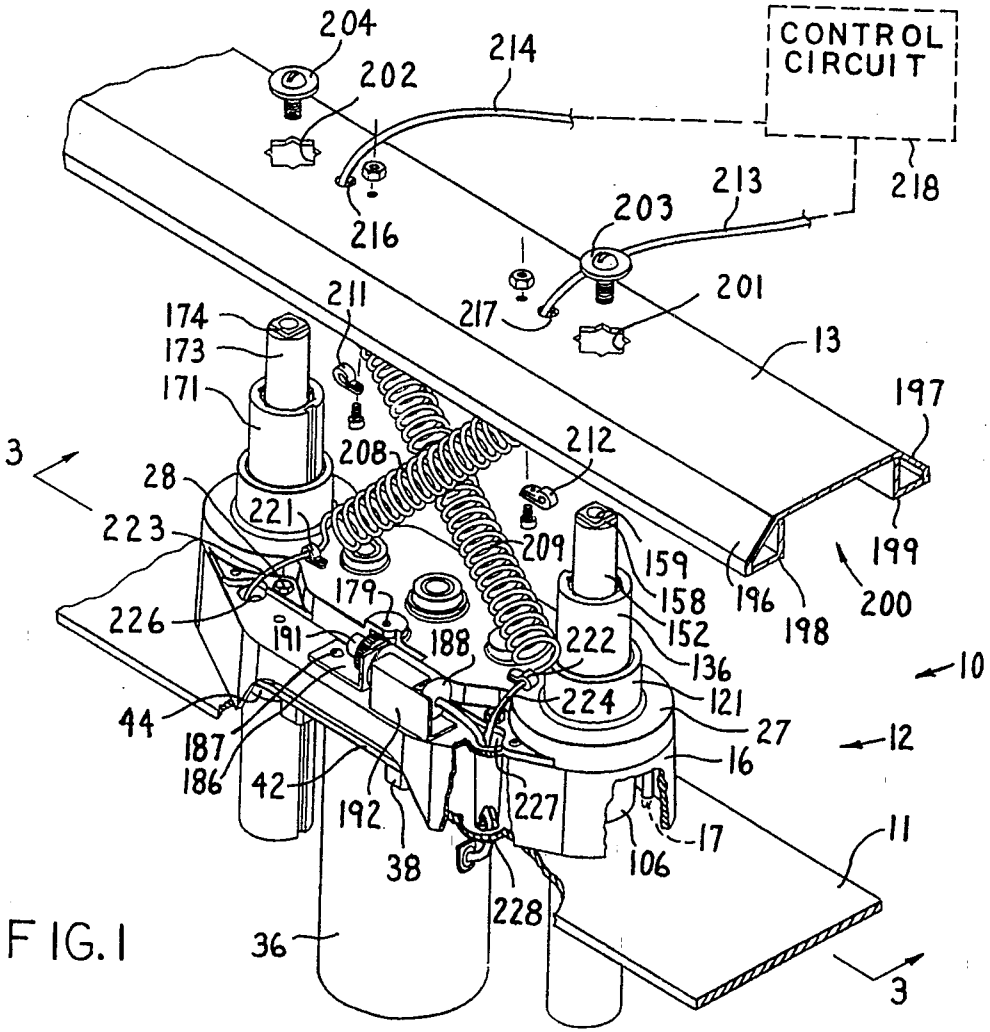
FIG. 1 is a partly exploded fragmentary perspective view of pertinent portions of a hospital bed embodying the present invention.

FIG. 1 depicts an apparatus 10 which is a portion of a hospital bed embodying the present invention. The apparatus 10 includes a metal plate 11 which is part of a mobile base of the bed, a metal support member 13 which is part of a support arrangement for a patient litter, and a lift mechanism 12 which is provided on the plate 11 and effects vertical movement of the support member 13 relative to the plate 11. The apparatus 10 of FIG. 1 is provided at each end of the bed to support opposite ends of the patient litter, but these mechanisms are identical and therefore only one is shown in FIG. 1. The lift mechanism 12, which is described in more detail below, is an improved version of a lift mechanism disclosed in copending U.S. Ser. No. 07/816,826, filed Jan. 3, 1992, the disclosure of which is hereby incorporated herein by reference.

The lift mechanism 12 includes a lower housing part 16 which, in the preferred embodiment, is a cast metal part disposed on top of the plate 11 and has two integral alignment pins projecting downwardly into respective holes in the plate 11, one of the alignment pins being shown at 17 in FIG. 1. The lower housing part 16 has four hexagonal recesses 18 (FIG. 2) in its upper surface 61. Four conventional and not-illustrated bolts each have a hexagonal head disposed within a respective recess 18, and have a shank extending downwardly through aligned openings in the housing 16 and plate 11, a not-illustrated nut being provided on each bolt shank below the plate 11 to fixedly secure the lower housing part 16 to the plate 11.

The lower housing part 16 has in its top surface two spaced blind holes 21 and 22, and two metal alignment pins 23 and 24 each have a lower end disposed with a force fit in a respective one of the holes 21 and 22, the upper ends of the pins 23 and 24 projecting above the top surface 61 of the lower housing part 16. An upper housing part 27 is also made of cast metal, has two spaced holes in its underside which each slidably receive a respective one of the alignment pins 23 and 24, and is fixedly secured to the top of the lower housing part 16 by four bolts 28 (FIG. 1) which each have a threaded shank engaging a threaded opening 29 (FIG. 2) in the lower housing part 16.

The lift mechanism 12 has a motor/gear assembly 36 which is a conventional part commercially available from Emerson Electric Co. of St. Louis, Mo. as part number K37XYC223700. The assembly 36 has at its upper end a square metal end plate 37 with a plastic mounting part 38 at each corner. The assembly 36 contains a reversible electric motor driving a speed-reducing gear train which terminates in a rotatably supported vertical output shaft 39 that projects above the end plate 37. The assembly 36 is secured to a glass-filled plastic mounting plate 42 by four bolts and associated nuts 43 which each extend through the plate 42 and a respective mounting part 38. The plate 42 has near each corner a circular opening. Each opening cooperates with a respective cylindrical rubber motor mount 44. In the preferred embodiment, each motor mount 44 is a sandwich of three separate circular disks, the center disk being disposed in and having a diameter approximately equal to the diameter of the associated opening in plate 42, and the two outer disks having diameters larger than the diameter of the center disk. Alternatively, each motor mount 44 could be a single integral structural part which is cylindrical and has a circumferential groove that cooperates with plate 42. Each motor mount 44 is secured to the underside of the lower housing part 16 by a respective one of four bolts 46, which each extend through a vertical hole in a respective motor mount 44 and engage a respective threaded hole in the lower housing part 16.

A metal driver 51 contains a set screw 53 (FIG. 3) which fixedly secures it to the output shaft 39 for rotation therewith, the driver 51 having two projections 52 extending radially outwardly in diametrically opposite directions from an annular hub portion thereof.

Figure 2:
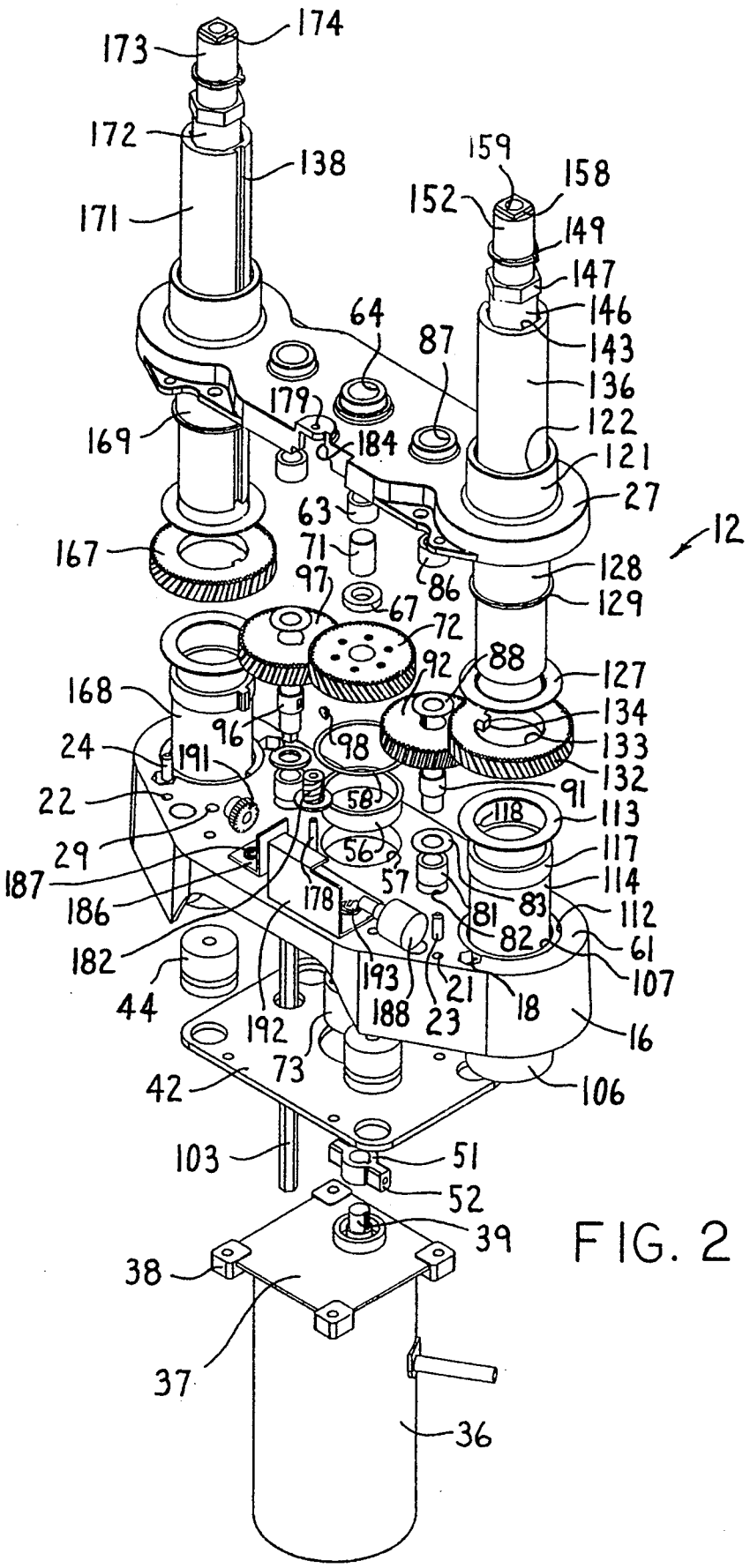
FIG. 2 is an exploded perspective view of a lift mechanism which is a component of the apparatus of FIG. 1.
Figure 3:
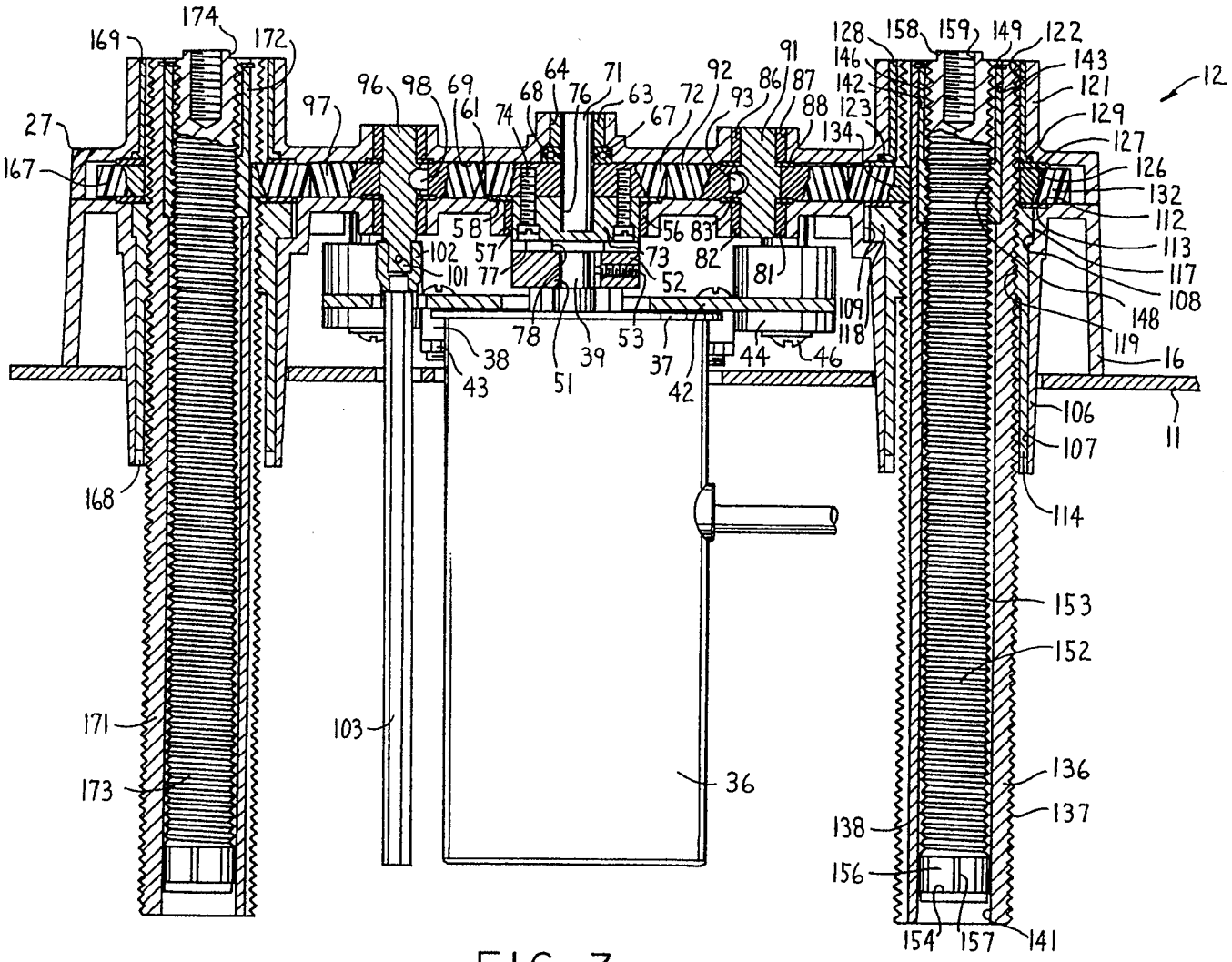
FIG. 3 is a sectional view of the lift mechanism of FIG. 2 taken along the line 3—3 in FIG. 1.

As shown in FIGS. 2 and 3, a cylindrical plastic bushing 56 is force fit in a cylindrical hole 57 extending vertically down through the lower housing part 16 from the upwardly-facing top surface 61 thereof. An annular thrust washer 58 rests on the top surface 61 concentric to the bushing 56, the washer 58 having an inside diameter approximately equal to the inside diameter of bushing 56 and having an outside diameter greater than the outside diameter of bushing 56.

A cylindrical bronze bearing 63 is force fit in a hole 64 which extends vertically through the upper housing part 27, the lower end of the hole 64 opening concentrically into a shallow circular recess 68 provided in a downwardly facing surface 69 of a downwardly open cavity in the upper housing part 27. The recess 68 contains an axial thrust bearing 67 which is a conventional ball bearing or roller bearing. The lower axial end of the bearing 67 is slightly vertically lower than the downwardly facing surface 69.

A cylindrical metal pin 71 has its upper end disposed in the bearing 63, and extends downwardly through the thrust bearing 67 to a location lower than the upwardly facing surface 61. A disklike wrought metal or powder metal drive gear 72 has a central opening through which the pin 71 snugly extends, the gear 72 and pin 71 being rotatable about the axis of pin 71. The gear 72 has helical teeth, and has a gear tooth root diameter greater than the outside diameter of thrust washer 58. The axial thickness of gear 72 is less than the distance between surfaces 61 and 69, and the axial ends of the gear 72 engage the washer 58 and thrust bearing 67, but do not directly engage the surfaces 61 and 69. A cylindrical plastic coupler 73 is concentrically disposed within and has an outside diameter slightly less than the inside diameter of bushing 56. The upper end of the coupler 73 is disposed against the underside of gear 72, and the coupler 73 is fixedly secured to the gear 72 by several bolts 74 provided at uniform angular intervals about the pin 71. Each bolt 74 has a head disposed in a countersunk vertical opening in the coupler 73, and a threaded upper end engaging a respective threaded hole in the gear 72. A cylindrical blind opening 76 extends downwardly into the coupler 73 and snugly receives the lower end of pin 71, and the lower end of the coupler 73 has a cylindrical hole 78 extending axially thereinto and a slot 77 extending radially thereacross, the hole 78 and the slot 77 respectively receiving the hub and the radial projections 52 of the driver 51 on shaft 39 of the motor/gear assembly 36.

The plastic plate 42, rubber mounts 44 and plastic coupler 73 serve to electrically isolate the motor 36 from the frame of the bed. Further, the plastic plate 42 and rubber mounts 44, in combination with the cooperation between driver 51 and coupler 73, serve to mechanically isolate the motor/gear assembly 36 from the lift mechanism housing and the bed frame, so that there is a negligible transfer of vibration from the assembly 36 to the rest of the bed.

Still referring to FIGS. 2 and 3, a bronze bushing 81 is disposed with a force fit in a vertical hole 82 extending through the lower housing part 16, and a metal thrust washer 83 resting on the surface 61 has inside and outside diameters which are respectively equal to and greater than the inside and outside diameters of bronze bushing 81. A further bronze bushing 86 is disposed with a force fit in a hole 87 in the upper housing part 27, and a metal thrust washer 88 disposed against the downwardly facing surface 61 has inside and outside diameters which are respectively equal to and greater than the inside and outside diameters of bushing 86. A metal shaft 91 has each of its axial end portions rotatably supported in a respective one of the bushings 81 and 86, and has a central portion which extends between the washers 83 and 88 and which has a diameter greater than that of the end portions but less than the outside diameter of the washers 83 and 88.

A disklike wrought metal or powder metal idler gear 92 has a central opening therethrough which snugly receives the central portion of the shaft 91 and which has an axially-extending keyway containing a Woodruff key 93, the key 93 also engaging an arcuate recess in the central portion of the shaft 91. The idler gear 92 has a gear tooth root diameter greater than the outside diameter of washers 83 and 88, and has helical teeth which engage the teeth on drive gear 72. The axial thickness of the idler gear 97 is less than the distance between surfaces 61 and 69, so that the axial ends of the gear 97 engage the washers 83 and 88 but do not engage the surfaces 61 and 69.

On the opposite side of pin 71 from shaft 91 is a similar shaft 96 rotatably supported by a similar bushing and washer arrangement and having an identical idler gear 97 keyed to it by a further Woodruff key 98. A detailed discussion of this similar structure is omitted, except for one difference. This difference is that the lower end of the shaft 96 has a downwardly-extending axial projection 101 of square cross section. A coupling member 102 has a square opening in its upper end which snugly receives the square lower end 101 of shaft 96, and has a hexagonal opening in its lower end which snugly receives the upper end of an elongate hexagonal rod 103. The rod 103 extends downwardly through an opening in the plate 42, and has its lower end disposed near a lower end of the motor/gear assembly 36.

Still referring to FIGS. 2 and 3, the lower housing part 16 has a cylindrical guide portion 106 which extends downwardly through an opening in the plate 11 of the bed base, the guide portion 106 having a cylindrical central opening 107 therethrough. Near the upper end of the opening 107 is a circular recess 108 concentric to and of greater diameter than the opening 107, and a notch 109 extends radially outwardly from the recess 108 on one side thereof. A shallow circular recess 112 of greater diameter than the recess 108 is provided in the upwardly facing surface 61, and a thrust washer 113 is disposed in the recess 112. The thrust washer 113 has an outside diameter approximately equal to the diameter of recess 112, so that recess 112 holds the washer 113 against radial movement, and has an inside diameter approximately equal to the diameter of opening 107. The washer 113 has a thickness greater than the depth of the recess 112, so that the washer 113 projects slightly above the surface 61 on lower housing part 16.

A cylindrical tubular nut member 114 is made of a relatively hard and durable plastic material such as nylon or acetal. The nut member 114 is disposed in the opening 107 through the guide portion 106, and has at its upper end a radially outwardly projecting annular collar 117 which is disposed in the recess 108, the upper end of the collar 117 being spaced slightly from the underside of washer 113. A tab 118 projects radially outwardly from the collar 117, and is disposed in the notch 109 in order to prevent rotational movement of the nut member 114 relative to the lower housing part 16. The upper one-third of the central opening through the nut member 114 has internal threads 119.

The upper housing part 27 has at one end an upwardly projecting cylindrical guide portion 121, which has therethrough a cylindrical central opening 122 coaxial with the opening 107 in the guide portion 106. A circular recess 123 is provided near the lower end of the opening 122 concentric therewith and has a diameter greater than that of the opening 122. A shallow circular recess 126 is provided in the downwardly facing surface 69 of the upper housing part 27 concentric to the opening 122, and has a diameter greater than that of the recess 123. A thrust washer 127 is disposed in the recess 126 and has a outside diameter approximately equal to the diameter of recess 126, so that the washer 127 is held against radial movement. The washer 127 has an inside diameter approximately equal to the diameter of opening 122, and has a thickness slightly greater than the depth of recess 126, so that washer 127 projects slightly below the surface 69. A cylindrical sleeve 128 is made of a relatively hard and durable plastic material such as DELRIN, is disposed within the opening 122, and has at its lower end a radially outwardly projecting annular flange 129 which is disposed in the recess 123 and is spaced slightly from the upper side of washer 127.

A disklike powder metal output gear 132 is rotatably disposed between the washers 113 and 127, and has a cylindrical central opening 133 (FIG. 2). An integral key portion 134 thereof projects radially inwardly into the opening 133. The gear 132 has helical teeth which engage the helical teeth of idler gear 92.

A tubular metal outer screw 136 extends vertically through the sleeve 128, washers 113 and 127, gear 132 and nut member 114, and has external threads 137 which engage the internal threads 119 of nut member 114. A slotlike axial keyway 138 extends the full length of outer screw 136, and slidably receives the key portion 134 on the gear 132. The outer screw 136 has a cylindrical opening 141 extending vertically through it, the upper end of the opening 141 having a portion 142 of increased diameter. A recess 143 of hexagonal cross section is machined in the upper end of the outer screw 136.

A cylindrical tubular nut member 146 is made of a relatively hard and durable plastic such as nylon or acetal, is disposed in the portion 142 of the opening through the outer screw 136, and has at its upper end a hexagonal collar which is disposed in and cooperates with the hexagonal recess 147 so as to prevent rotation of the nut member 146 relative to the outer screw 136. The lower one-third of the vertical opening through the nut member 146 has internal threads 148. The nut member 146 is releasably held within the outer screw 136 by a snap ring 149, which engages a circumferential groove provided in the hexagonal recess 147.

A solid metal inner screw 152 extends through the outer screw 136 and through nut member 146, and has external threads 153 which engage the internal threads 148 of the nut member 146. The inner screw 152 has near its lower end a shallow circumferential groove 154, and a plastic glide ring 156 made of acetal is disposed within the groove 154 and has an outside diameter slightly greater than the outside diameter of the external threads 153. The glide ring 156 is split at 157 in order to permit it to be snapped around the inner screw 152 during assembly. A square boss projects upwardly a small distance from the upper end of the inner screw 152, and a threaded hole 159 extends downwardly into the inner screw 152 from the upper end of the boss 158.

At the opposite end of the housing parts 16 and 27 is an arrangement which is identical to that just described, and which will thus be not described in detail. This arrangement includes an output gear 167, nut member 168, sleeve 169, outer screw 171, nut member 172 and inner screw 173, which are respectively equivalent to the output gear 132, nut member 114, sleeve 128, outer screw 136, nut member 146 and inner screw 152. The inner screw 173 has at its upper end a square boss 174 equivalent to the boss 158 on inner screw 152. The output gear 167 has helical teeth which engage the teeth on idler gear 97.

Referring to FIG. 2, a metal pin 178 has its lower end fixedly secured by force fit in a hole which extends into the lower housing part 16 from the upwardly facing surface 61 thereon, and has its upper end slidably received in a hole 179 in the upper housing part 27. The pin 178 rotatably supports a gear 182 which has at its lower end a disklike spur-toothed (or helically-toothed) portion engaging the helical teeth of the drive gear 72, and which has a worm portion above the spur-toothed portion, the worm portion being accessible from outside the housing through an opening 184 provided in a side surface of the upper housing part 27.

An L-shaped metal plate 186 has a horizontal leg disposed against the upwardly facing surface 61 on the lower housing part 16 at a location laterally offset from the upper housing part 27, the plate 186 being fixedly secured to the lower housing part 16 by a bolt 187 which extends through the horizontal leg and engages a threaded opening in the lower housing part. The L-shaped plate 186 also has a vertical leg on which a potentiometer 188 is fixedly mounted, so that a rotatable shaft of the potentiometer extends rotatably through a not-illustrated hole in the vertical leg of the plate 186. The shaft of the potentiometer has fixedly secured to it a potentiometer gear 191, which is a worm gear that engages the worm on gear 182. A U-shaped plate 192 has two horizontally extending legs connected by a vertically extending bight, one of the horizontally extending legs being disposed below the potentiometer 188 and being secured to the lower housing part by a bolt 193, the bight extending vertically upwardly on the outer side of the potentiometer, and the upper horizontal leg extending inwardly to a location above the potentiometer 188, in order to protect the potentiometer.

Referring to FIG. 1, the support member 13 is a metal plate with side portions 196 and 197 bent to extend downwardly at an incline. Two L-shaped channels 198 and 199 are welded to the side portions 196 and 197, in order to rigidify the support member 13. The region between the members 198 and 199 serves as a recess or pocket 200, for a purpose described later.

The member 13 has two spaced openings 201 and 202 therethrough, each of which has the shape of an eight-pointed star. The openings 201 and 202 respectively receive the square bosses 158 and 174 on the inner screws 152 and 173. The member 13 is fixedly secured to inner screws 152 and 173 by two button washer head bolts 203 and 204, which engage the threaded openings provided in the upper ends of the inner screws 152 and 173. During assembly, if the member 13 is not properly leveled, one of the bolts 203 and 204 can be removed, the associated inner screw 152 or 173 can then be disengaged from member 13 and turned (to adjust its vertical height) until a level state of member 13 is achieved, and then the bolt can be reinserted. The eight-pointed openings 201 and 202 allow finer resolution during this leveling operation than would four-pointed (square) openings, because the eight-pointed openings permit each inner screw to be adjusted with 45° increments, whereas a four-pointed opening allows adjustment only at 90° increments.

Two electrical cords have coiled central portions 208 and 209, the upper end of each coiled central portion being secured the underside of the member 13 adjacent a respective one of the openings 201 and 202 by a respective clip 211 or 212 made of rubber-coated metal and bolted to the member 13. Each cord has a straight end portion 213 or 214 which extends from one of the clips 211 or 212 through a respective hole 216 or 217 in the member 13, and then to a control circuit shown diagrammatically at 218. Two further clips 221 and 222 made of rubber-coated metal are each bolted to the upper housing part 27 adjacent a respective one of the cylindrical guide portions 221, and each hold the lower end of a respective coiled central portion 208 or 209. From there, straight end portions 223 and 224 of the cords then extend through respective vertical wiring holes 226 and 227 provided through the lower housing part 16. The holes 226 and 227 each extend completely through the lower housing part to the plate 11, and are each aligned with a respective opening 228 provided through the plate 11 of the base of the bed. The portion 224 of cord 209 is connected to the electric motor in the motor/gear assembly 36. The portion 223 of cord 208 includes wires which are connected to the potentiometer 188, and may include additional wires connected to other electrical components which are not pertinent to the present invention and are therefore not illustrated and described.

OPERATION

Assume that the support member 13 is initially in a lowered position relatively close to the upper housing part 27, the coiled central portions 208 and 209 of the cords being disposed within the pocket 200 of the member 13. If the electric motor is then actuated, the shaft 39 will rotate the driver 51, which in turn will rotate the coupler 73 and drive gear 72. The plastic plate 42 and plastic coupler 73 electrically isolate the motor from other components, for purposes of safety. Further, the plate 42 and rubber mounts 44, in combination with the cooperation between drive member 51 and the slot 77 and coupler 73, minimize the extent to which vibrations of the motor/gear assembly 36 are transferred to other components of the drive mechanism, for purposes of patient comfort.

As the rotationally driven output gear 72 rotates the idler gears 92 and 97, which in turn rotate the output gears 132 and 167, the helical teeth on these gears minimize noise so that the lift assembly operates very quietly. The cooperation of the helical teeth on drive gear 72 and idler gears 92 and 97 will tend to urge the drive gear 72 axially upwardly when the drive shaft 39 is being rotated in a direction which will effect upward movement of the support member 13, and this upward force is absorbed by the thrust bearing 67 so that there is minimal friction resisting rotation. As the idler gears 92 and 97 in turn rotate the output gears 132 and 167, the cooperation of the helical teeth thereon will cause the output gears 132 and 167 to be urged axially downwardly by the idler gears 92 and 97 when the lift mechanism is raising the support member 13. As discussed below, this has the advantage of reducing some of the friction which otherwise necessarily acts on the output gears 132 and 167.

As the output gears rotate, the key portion 134 of each forces the associated outer screw 136 or 171 to rotate with the output gear. The cooperation between the external threads of the outer screw 136 or 171 with the internal threads of the nut member 114 or 168 will cause the outer screws 136 and 137 to move upwardly. Simultaneously, since the inner screws 152 and 173 are held against rotation by virtue of their connection to the member 13, the cooperation between the internal threads on the nut members 146 and 172 rotating with the outer screws 136 and 171 relative to the external threads on the inner screws 152 and 173 will cause the inner screws to simultaneously move upwardly relative to the outer screws. The member 13 moves upwardly with the inner screw members, and the coiled portions 208 and 209 of the cords expand and form the "X" configuration shown in FIG. 1. Since the gear train causes the output gears to rotate synchronously, the outer screws also rotate synchronously and lift the member 13 evenly with no tendency for side-to-side tilt of member 13 or the patient support surface.

Since the driving forces being applied to the outer screws 136 and 171 by the output gears are concentrated at the key portions 134 of the output gears, the friction between the key portions 134 and the surfaces of the axial slots 138 in the outer screws creates a good deal of frictional resistance to relative axial movement of the output gears along the outer screws. The output gears 132 and 167 will thus be urged upwardly relative to the housing by this frictional engagement with the upwardly-moving outer screws. However, since the helical threads on the idler gears 92 and 97 are at the same time urging the output gears 132 and 116 axially downwardly, the upward and downward axial forces acting on each output gear offset each other to some extent, which serves to reduce the friction between the upper side of each output gear and the thrust washers against which they are axially urged, thereby making the illustrated lift mechanism more efficient as a result of the presence and orientation of the helical teeth on the gears.

Also, as the motor rotates the drive gear 72, the spur portion of gear 182 is rotated by the drive gear 72, and the worm portion thereof in turn rotates the potentiometer gear 191, which turns the shaft of the potentiometer. Thus, by monitoring the resistance of the potentiometer, the control circuit 218 can keep track of the vertical position in which the member 13 has been positioned by the lift mechanism 12.

The electric motor is stopped in order to halt upward movement of the member 13 and to maintain the member 13 in its current position. To subsequently lower the member 13, the motor is energized to rotate in the oppose direction, which causes all components of the drive train to move in directions opposite to that discussed above. As a result, the outer screws 136 and 171 and the inner screws 152 and 173 move simultaneously downwardly so that the support member 13 moves downwardly. As the support member 13 moves downwardly, the inherent resilience in the coiled portions 208 and 209 of the cords takes up all slack in these portions of the cords, so that these portions each continue to extend relatively directly between a respective pair of clips 212 and 221 or 211 and 222. Consequently, as the member 13 moves into close proximity with the upper housing part 27, the central portions 208 and 209 of the cords will automatically move back to their original positions disposed within the pocket or recess 200 in the member 13. Of course, as the lift mechanism moves the support member 13 downwardly, the drive gear 72 will rotate the shaft of potentiometer 188 through gears 182 and 191, so that the control circuit 218 receives an accurate electrical indication of the vertical position of the member 13.

In the event of a power outage or a failure of the electric motor, and also for purposes of maintenance and test, the hexagonal rod 103 can be used to manually drive the lift mechanism 12. More specifically a conventional hexagonal box-end or socket wrench can be slipped onto the lower end of the rod 103 and used to manually rotate the rod 103 in order to rotate the idler gear 97, which in turn rotates the gears 167, 72, 92, 132, 182 and 191.

Although a single preferred embodiment of the invention has been described in detail for illustrative purposes, it will be recognized that there are variations and modifications of the disclosed apparatus, including the rearrangement of parts, which lie within the scope of the present invention.

The embodiments of the invention in which an exclusive property or privilege is claimed are defined as follows:

1. An apparatus comprising:

first and second members and lift means cooperable with said first and second members for effecting relative vertical movement thereof, said lift means including a vertically extending threaded member, a motor, and drive train means for effecting vertical movement of said threaded member in response to operation of said motor, said drive train means including noise reducing means for reducing noise generated by said drive train means, said noise reducing means including first and second gears having engaging helical teeth;

wherein said drive train means includes a further vertically extending threaded member, a drive gear rotatably driven by said motor, two idler gears each rotatably driven by said drive gear, and two output gears each driven by a respective said idler gear and drivingly engaged with a respective said threaded member, each of said drive gear, said idler gears and said output gears having helical teeth, one of said idler gears and the output gear engaged therewith being said first and second gears.

2. An apparatus comprising:

first and second members and lift means for effecting relative vertical movement of said first and second members, said lift means including a vertically extending threaded member, a rotatably supported output member, and means for effecting axial movement of said threaded member in response to rotation of said output member, said output member being urged in a first axial direction in response to axial movement of said member, and including drive means for effecting rotation of said output member and for simultaneously urging said output member in a second axial direction opposite said first axial direction.

3. An apparatus of claim 2, wherein said output member is a gear having helical teeth, and said drive means includes a rotatably driven further gear having helical teeth which engage said helical teeth on said output member, said helical teeth on said further gear and said output member being oriented so that said further gear urges said output member both rotationally and axially in said second axial direction during rotation of said gears.

4. An apparatus of claim 3, including a drive gear rotatably driven by a motor and having helical teeth, first and second rotatably supported idler gears each having helical teeth engaging said teeth of said drive gear, said first idler gear being said further gear, a further output member which is rotatably supported and has helical teeth engaging said helical teeth on said second idler gear, a further vertically movable threaded member, means for effecting vertical movement of said further threaded member in response to rotation of said further output member, and a roller thrust bearing disposed between said drive gear and a stationary housing so that forces urging said drive gear in said second axial direction urge said drive gear against said roller thrust bearing.

5. An apparatus of claim 4, wherein each of said threaded members is an externally threaded cylindrical member, wherein said housing includes spaced horizontal first and second surfaces which face each other, said drive gear, said idler gears and said output members being disposed between said first and second surfaces, wherein said output members are each an annular gear which encircles a respective one of said threaded members, wherein said drive gear, said idler gears and said output members each have an axial thickness which is less than a distance between said first and second surfaces, and including two thrust washers disposed on respective sides of each of said idler gears and said output members coaxial therewith and a thrust washer disposed coaxially with said drive gear on a side thereof remote from said roller thrust bearing.

6. An apparatus of claim 5, wherein said first and second surfaces each have two circular recesses which are each concentric to the axis of rotation of a respective said output member, which each have an outside diameter substantially equal to the outside diameter of and an axial depth less than the axial thickness of a respective said thrust washer for said output members, said thrust washers for said output members each engaging a respective said circular recess.

7. An apparatus comprising:

first and second members and lift means for effecting relative vertical movement of said first and second members, said lift means including an elongate cylindrical member having external threads thereon and including a tubular nut member disposed in an opening in a further member and having internal threads which engage said external threads of said cylindrical member, said opening in said further member having at an upper end thereof an enlarged portion and said nut member having adjacent an upper end thereof a collar portion which is disposed in said enlarged portion of said opening, said collar portion and said enlarged portion having means for preventing rotation of said nut member relative to said further member, and including means for effecting relative rotation between said cylindrical member and said further member to thereby effect vertical movement of said cylindrical member relative to said nut member and said further member.

8. An apparatus of claim 7, wherein said means for preventing relative rotation of said nut member and said further member includes said further member having a notch extending radially outwardly from said enlarged portion of said opening, and includes said nut member having a tab which projects radially outwardly from said collar thereon and which is disposed in said notch in said further member.

9. An apparatus of claim 7, wherein said means for preventing relative rotation of said nut member and said further member includes said enlarged portion of said opening and said collar on said nut member being of congruent noncircular shape.

10. An apparatus of claim 7, including a housing having upper and lower parts which respectively have thereon a downwardly facing first surface and an upwardly facing second surface, said surfaces being approximately parallel and horizontal and facing each other, said lower housing portion being said further member, and said upper housing portion having therethrough an opening coaxial with said opening through said lower housing portion, said means for preventing rotation of said nut member relative to said lower housing portion including said lower housing portion having a notch which extends radially outwardly from said enlarged portion of said opening therethrough, and said nut member having a tab which projects radially outwardly from said collar and is disposed in said notch in said lower housing portion.

11. An apparatus of claim 10, wherein said cylindrical member has an axial slot extending lengthwise thereof, and including an annular output member which is supported for rotation between said first and second surfaces, which encircles said cylindrical member, and which has a key part slidably engaging said axial slot in said cylindrical member, wherein said first and second surfaces each have a circular recess concentric to an axis of rotation of said output member, and including first and second thrust washers which each have an outside diameter approximately equal to an outside diameter of and which each have an axial thickness greater than and extend axially into a respective said circular recess, said first and second thrust washers engaging said output member on opposite sides thereof, and said collar portion of said nut member being adjacent one of said thrust washers on a side thereof opposite from said output member.

12. An apparatus of claim 7, wherein said further member is an elongate cylindrical member which is supported for rotational and axial movement relative to one of said first and second members, wherein said means for preventing relative rotation of said nut member and further member includes said enlarged portion of said opening and said collar on said nut portion being of congruent noncircular shape, and including a retaining member removably disposed in and engaging said further member immediately above said nut member to prevent upward movement of said nut member relative to said further member.

13. An apparatus comprising:

first and second members and lift means for effecting relative vertical movement of said first and second members, said lift means including a housing provided on said first member and having a threaded part thereon, a vertically extending cylindrical member coupled to said second member and having external threads which engage said threaded part, a selectively actuable motor, and drive train means for effecting relative rotation between said cylindrical member and said threaded part in response to operation of said motor and a motor support part supported on said housing and made of an electrically nonconductive material, said motor being supported on said motor support part, and said drive train means including an electrically nonconductive coupling part which electrically isolates said motor from said drive train means, wherein said motor support part is a horizontally extending plate which is coupled to said housing at spaced predetermined locations, said motor being supported on said plate at a further location thereon spaced from said predetermined locations and being oriented so that a rotatably supported output shaft thereof extends approximately perpendicular to said plate, and wherein said drive train means includes a driver mounted on said shaft of said motor and a further part cooperating with said driver so as to be held against rotation with respect thereto but so as to be capable of limited axial movement with respect thereto.

14. An apparatus of claim 13, wherein said driver has a hub and two projections which extend radially outwardly from said hub in diametrically opposite directions, and wherein said further part is said coupling part, has an opening which extends thereinto in a direction approximately parallel to the shaft of said motor and has two slots which extend radially outwardly from said opening therein, said hub and said projections on said driver being axially slidably received within said opening and said radial slots in said coupling part.

15. An apparatus according to claim 14, wherein said plate has a respective rubber mount mounted thereon at each of said predetermined locations, each said rubber mount being bolted to said housing.

16. A bed comprising:

a base portion, a patient support portion, and lift means cooperable with said base portion and said patient support portion for effecting vertical movement of said patient support portion relative to said base portion, including a coiled electrical cord extending between a first location on said base portion and a second location on said patient support portion, said coiled electrical cord including means integral to said cord for causing said cord to automatically expand and contract in length in response to vertical movement of said patient support portion relative to said base portion.

17. A bed comprising:

a base portion;

a patient support portion;

lift means cooperable with said base portion and said patient support portion for effecting vertical movement of said patient support portion relative to said base portion;

and a coiled electrical cord extending between a first location on said base portion and a second location on said patient support portion, said coiled electrical cord expanding and contracting in response to vertical movement of said patient support portion relative to said base portion;

wherein said first and second locations are horizontally offset when said patient support portion is in a lowered position adjacent said base portion, one of said base portion and said patient support portion having therein a recess which receives said coiled electrical cord when said patient support portion is adjacent said base portion.

18. An apparatus of claim 17, including a further coiled electrical cord extending between a third location on said base portion spaced from said first location and a fourth location on said patient support portion spaced from said second location, said coiled electrical cords both being received in said recess when said patient support portion is adjacent said base portion.

19. An apparatus of claim 17, wherein said base portion includes a metal plate and includes a housing for said lift means which is mounted on said metal plate, said housing and said metal plate having aligned openings therein, and said cord having a further portion which extends away from said coiled portion through said aligned openings in said housing and said plate.

20. An apparatus comprising:

first and second members and lift means for effecting relative vertical movement of said first and second members, said lift means including vertically extending first and second cylindrical members which have external threads and which each have at one end thereof a noncircular portion, including first and second threaded parts which are each rotatably supported with respect to said first member and each engage a respective said cylindrical member, and including a selectively actuable motor and means driven by said motor for simultaneously effecting rotation of each of said threaded parts relative to the cylindrical member engaged therewith, said second member having therein two spaced noncircular openings which each receive the noncircular portion of a respective one of said first and second cylindrical members to prevent rotation of said cylindrical members relative to said first member and each other, wherein each said noncircular opening can receive the associated noncircular portion in two different angular orientations.

21. An apparatus of claim 20, wherein said noncircular portion of each said cylindrical member has the shape of a regular polygon, and wherein each said noncircular opening in said second member is a star-shaped opening having a number of points which is an integer multiple of the number of sides of said regular polygon.

22. An apparatus comprising:

first and second members and lift means for effecting relative vertical movement of said first and second members, said lift means including a vertically extending cylindrical member coupled to said first member and a threaded part supported on said second member and engaging said cylindrical member, a selectively actuable motor, drive train means driven by said motor for effecting relative rotation of said threaded part and said cylindrical member to thereby effect relative axial movement thereof, a potentiometer having a shaft, said drive train means including means for rotating said shaft of said potentiometer synchronously with relative rotation of said threaded part and cylindrical member so that said potentiometer outputs an electrical signal representative of the relative vertical position of said first and second members, and a circuit having an input to which said signal from said potentiometer is applied.

23. An apparatus of claim 22, wherein said drive train means includes at least one rotatable gear, includes a further gear having a spur portion engaged with said rotatable gear and having a worm portion, and includes a potentiometer gear on said shaft of said potentiometer which engages said worm portion.

24. A bed comprising:

a base portion, a patient support portion, and lift means for effecting vertical movement of said patient support portion relative to said base portion, said lift means including a vertically extending cylindrical member which is externally threaded, a threaded part which engages the external threads on said cylindrical member, a selectively actuable motor, and drive train means driven by said motor for effecting relative rotation of said cylindrical member and threaded part so that said cylindrical part moves vertically relative to said threaded part, said drive train means including a manual drive member which can be manually moved to cause said drive train means to effect said relative rotation of said cylindrical member and said threaded part, said manual drive member having means thereon shaped for engagement by a standard wrench.

25. A bed comprising:

a base portion, a patient support portion, and lift means for effecting vertical movement of said patient support portion relative to said base portion, said lift means including a vertically extending cylindrical member which is externally threaded, a threaded part which engages the external threads on said cylindrical member, a selectively actuable motor, and drive train means driven by said motor for effecting relative rotation of said cylindrical member and threaded part so that said cylindrical member moves vertically relative to said threaded part, said drive train means including a manual drive member which can be manually moved to cause said drive train means to effect said relative rotation of said cylindrical member and said threaded part, and wherein said drive train means includes two gears with engaging teeth, said manual drive member being a rod having an axis approximately coaxial to an axis of rotation of and being nonrotatably coupled at one end to one of said gears, said rod having at an opposite end a portion with a cross sectional shape which is a regular polygon.

* * * * *